US006120559A

United States Patent [19]

Bell

[11] Patent Number: 6,120,559

[45] Date of Patent: Sep. 19, 2000

[54] TREATMENT OF DYED NYLON FIBERS TO PREVENT DEGRADATION CAUSED BY ULTRAVIOLET LIGHT

[75] Inventor: Michael E. Bell, Lexington, Va.

[73] Assignee: Burlington Industries, Inc., Greensboro, N.C.

[21] Appl. No.: 09/311,639

[22] Filed: May 14, 1999

Related U.S. Application Data

[63] Continuation of application No. 09/066,975, Apr. 28, 1998, abandoned.

[51] Int. Cl.[7] ..... D06P 5/02; D06P 1/38; D06P 1/39; D06P 3/24

[52] U.S. Cl. ..... 8/442; 8/490; 8/543; 8/924; 8/929; 8/DIG. 21

[58] Field of Search ..... 8/442, 490, 491, 8/543, 924, 929, DIG. 21, 674, 685

[56] References Cited

U.S. PATENT DOCUMENTS

| | | | |
|---|---|---|---|
| 3,905,952 | 9/1975 | Speck | 8/587 |
| 4,043,749 | 8/1977 | Huffman | 8/531 |
| 4,295,329 | 10/1981 | Windley | 57/245 |
| 4,350,494 | 9/1982 | Scheidegger et al. | 8/636 |
| 4,592,940 | 6/1986 | Blyth et al. | 428/96 |
| 4,681,596 | 7/1987 | Back et al. | 8/620 |
| 4,780,099 | 10/1988 | Greschler et al. | 8/115.6 |
| 4,800,118 | 1/1989 | Reed et al. | 428/270 |
| 4,908,149 | 3/1990 | Moore et al. | 510/278 |
| 5,131,918 | 7/1992 | Kelley | 8/549 |
| 5,445,653 | 8/1995 | Hixson et al. | 8/531 |
| 5,484,455 | 1/1996 | Kelley | 8/539 |
| 5,707,469 | 1/1998 | Hixson et al. | 156/72 |

FOREIGN PATENT DOCUMENTS

| | | |
|---|---|---|
| 26 15 759 | 10/1976 | Germany . |
| 1143955 | 6/1969 | United Kingdom . |
| 1458632 | 12/1976 | United Kingdom . |

OTHER PUBLICATIONS

Perkins, ATI, Oct. 1996, pp. 60,62,64, Dyeing and Finishing "Today's Principles of Dyeing Nylon."

Kratzel, Knitting Technique, vol. 11 (1989), No. 5 p. 416, "What is meant by pH value?" and Abstract. (No month avail.).

Salvin, American Dyestuff Reporter, Feb. 1968, pp 51–54, "The Effect o Dyes on Light Degradation of Nylon."

Little—Meetings of Scottish Jr. Section, Oct. 1963, pp 527–533, "The Effect of Light on Textiles."

*Primary Examiner*—Caroline D. Liott

*Attorney, Agent, or Firm*—Nixon & Vanderhye

[57] ABSTRACT

A process for arresting or attenuating ultraviolet induced damage to nylon fibers comprising dyeing cationic dyeable nylon fibers at a pH of about 2.5 or less with an acid dye, a fiber reactive dye or premetallized acid dye and, subsequent to exposing said fibers to fiber damaging amounts of ultraviolet light, applying a neutralizing aqueous solution having a pH of about 7.5 or greater to said fibers, thereby arresting or attenuating ultraviolet induced damage to said nylon fibers. The nylon fibers may be in a carpet which may be treated after installation.

4 Claims, No Drawings

TREATMENT OF DYED NYLON FIBERS TO PREVENT DEGRADATION CAUSED BY ULTRAVIOLET LIGHT

This is a continuation of application Ser. No. 09/066,975, filed Apr. 28, 1998, now abandoned.

This invention relates to processing nylon fibers that have been previously dyed under low pH conditions to render the dyed nylon fiber resistant to the degradation effects of ultraviolet light.

Nylon fibers are widely used for tufting into carpets and of such fibers the cationic-dyeable nylons are preferred for their innate ability to resist the effects of stains, particularly acid-based stains from food and the like. In order to provide a full range of shades while maintaining the desired resistance to staining acid cationic dyeable nylon fibers have been dyed with acid or premetalized acid dyes under low pH conditions, such as pH 2.5 and lower as described in Jenkins U.S. Pat. Nos. 5,466,527; 5,571,290; 5,199,958 and 5,350,342 and Boyes U.S. Pat. No. 5,626,362 or with fiber reactive dyes as in Hixson U.S. Pat. No. 5,445,653 (the disclosures of these patents are hereby incorporated by reference). A major end use for nylon fibers dyed under such conditions is in commercial and residential carpet in which the nylon carpet yarns are exposed to a range of challenges including exposure to ultraviolet light. While these patents describe procedures for dyeing cationic dyeable nylon with anionic dyes under various pH conditions all less than neutral, nylon fibers dyed at about pH 2.5 or below are particularly vulnerable to the effects of ultraviolet light.

It has been observed that nylon carpet fibers dyed under low pH conditions are apt to degrade due as a consequence of loss in strength and elongation resulting from exposure to ultraviolet light. Degradation is particularly notable when cationic dyeable acid dyed fibers are mixed with acid dyeable nylon fibers.

Nylon carpet yarns which were dyed at a pH of 2.5 or lower exhibit a significantly greater loss of tensile strength and elongation when exposed to ultraviolet radiation such as that found in fluorescent lighting, than the same yarns which were dyed at higher pH values. For carpets containing both, those dyed at low pH break and disintegrate with normal wear while those dyed at higher pH maintain their integrity.

It has been discovered that such nylon carpet yarns dyed at low pH can be given a neutralization treatment with an alkaline solution prior to exposure to the ultraviolet radiation, which significantly reduces the loss in strength and elongation. It has also been discovered that neutralization after short ultraviolet exposure prevents further degradation of such yarns, as long as the alkaline treatment is controlled to prevent adverse effects on the dyes and desired color. Neutralization after exposure to ultraviolet light is particularly convenient as an after treatment, that is after the nylon yarns have been dyed, but without the preventive neutralizing treatment, and have been installed and are in use such as in residential and commercial carpeting. Treatment after installation allows remedial action after partial damage and degradation have been detected thereby avoiding removal and re-installation or replacement. This invention includes a process for preventing or reducing ultraviolet light induced degradation of cationic dyeable nylon carpet fibers dyed under acid conditions of about pH 2.5 or less by subjecting the dyed fibers to conditions of about pH 7.5 or above to neutralize the nylon fibers and render them resistant to or exhibiting reduced degradation, loss in strength and elongation.

Also disclosed is an improved process of dyeing cationic dyeable nylon with an acid dye, a premetalized acid dye or a fiber reactive acid dye at a pH of about 2.5 or less, the improvement including preventing or reducing ultraviolet light induced degradation of the dyed nylon fibers, comprising subjecting the dyed fibers to neutralizing conditions. Preferably the dyed nylon fibers are treated with a neutralizing aqueous solution of at least about pH 7.5.

Another embodiment of the invention is a process for arresting or attenuating ultraviolet induced damage to nylon fibers comprising subjecting cationic dyeable nylon fibers, dyed at a pH of about 2.5 or less and subsequently exposed to fiber damaging amounts of ultraviolet light, to a neutralizing aqueous solution having a pH of about 7.5 or greater thereby arresting ultraviolet induced damage to said nylon fibers. The fibers may be in a carpet to which the aqueous solution is applied.

Disclosed is a process for reducing or preventing ultraviolet light induced degradation of nylon carpet fibers dyed at a pH of 2.5 or less by subjecting these fibers to pH conditions of at least about pH 7.5 and preferably pH 9 to pH 11. The process may be conducted at various stages of carpet fabrication subsequent to the low pH dyeing, for instance by subjecting the nylon yarn to neutralizing conditions such as an aqueous alkaline solution, after the dyed yams are tufted into carpet or subsequent to carpet construction and even after installation.

Degradation can be halted or slowed significantly by the application of various alkaline materials such as sodium sulfide, sodium sulfate, sodium bicarbonate, sodium carbonate, sodium thiosulfate, monosodium phosphate and trisodium phosphate. Other materials may be similarly suited to the process. Sodium carbonate and sodium bicarbonate are preferred as they appear to yield the most consistent results. Concentrations of 6.4% and 5% respectively, were applied at a wet pick-up of at least 250% via extraction cleaner but not extracted immediately. Exposure time was at least 5 minutes, followed by air drying.

Prior to drying, yarn or carpet dyed at a low pH could be rinsed with a solution of the alkaline materials. This rinse may require total saturation of the substrate. Concentration of the alkaline material may be related to the molar equivalent of acidic material still present in the substrate, or the pH attributed to that material. If possible, this alkaline rinse may be the last step before dyeing, i.e. no water rinse, if the alkaline condition does not adversely affect the quality of the substrate, both esthetically and physically. A further water rinse may be advisable to reduce or remove residuals. Very high pH can affect shade or fastness, and proper application of subsequent finishes such as fluorochemicals thus the specific pH and other treating conditions will be adjusted to avoid unwanted results.

Application before drying is preferred. If this is not possible, treatment of dry material with the above-noted actives would be effective but may require surface active agents to obtain thorough wetting of the substrate.

The invention is further explained with reference to the following non-limiting examples:

EXAMPLE 1

A carpet containing yarns dyed at a pH less than 2.5 is neutralized by application of 50 g/l of sodium bicarbonate either in conjunction with a carpet detergent to help wet out the carpet, or after application of the wetter. The sodium bicarbonate solution is applied via customary carpet extraction cleaning equipment and allowed to air dry. The detergent is omitted if the carpet appears to wet satisfactorily with just the sodium bicarbonate solution. Sodium carbonate at 64 g/l has shown equal effectiveness when applied the same way.

EXAMPLE 2

In a continuous process of dyeing solid or multicolor yarn, yarn dyed at a pH of less than 2.5 is neutralized by application of sodium bicarbonate at 50 g/l, or sodium carbonate at 60 g/l, by immersing the yarn in the neutralizing solution. Rinsing may not be necessary if the resultant pH has no adverse effect on other properties such as fastness or proper application of subsequent finishes such as fluorochemical antisoil treatments. If rinsing is necessary to reduce the alkalinity of the final yarn, a residence time of about 20–30 seconds prior to immersion in rinse water is sufficient.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for arresting or attenuating ultraviolet induced damage to nylon fibers comprising:

dyeing cationic dyeable nylon fibers at a pH of about 2.5 or less with a premetallized acid dye; and subsequent to exposing said fibers to fiber damaging amounts of ultraviolet light, applying a neutralizing aqueous solution having a pH of about 7.5 or greater to said fibers thereby arresting or attenuating ultraviolet induced damage to said nylon fibers.

2. The process of claim 1 wherein said fibers are in a carpet and the aqueous solution is applied to the carpet.

3. A method for arresting or attenuating ultraviolet induced damage to nylon fibers, which have been dyed at a pH of about 2.5 or less with an acid dye, a premetallized acid dye or a fiber reactive dye, after installation of a carpet containing said fibers, comprising the steps of;

subsequent to exposing the fibers of the installed and dyed carpet to fiber damaging amounts of ultraviolet light, applying a neutralizing aqueous solution having a pH of about 7.5 or greater to said fibers in the installed carpet thereby arresting or attenuating ultraviolet induced damage to the nylon fibers of the installed carpet.

4. The process of claim 3 wherein the fibers are dyed with an acid dye or a premetallized acid dye.

* * * * *